United States Patent [19]

Rimai et al.

[11] Patent Number: 4,737,433

[45] Date of Patent: Apr. 12, 1988

[54] ELECTROSTATOGRAPHIC METHOD OF MAKING IMAGES

[75] Inventors: Donald S. Rimai; Arun Chowdry, both of Webster, N.Y.

[73] Assignee: Eastman Kodak Company, Rochester, N.Y.

[21] Appl. No.: 926,069

[22] Filed: Nov. 3, 1986

[51] Int. Cl.[4] ..... G03G 9/08

[52] U.S. Cl. ..... 430/111; 430/126

[58] Field of Search ..... 430/111, 109, 106.6, 430/126

[56] References Cited

U.S. PATENT DOCUMENTS

| | | | |
|---|---|---|---|
| 3,969,251 | 7/1976 | Jones et al. | 252/62.1 P |
| 4,284,701 | 8/1981 | Abbott et al. | 430/111 |
| 4,504,562 | 3/1985 | Miyakawa | 430/111 |
| 4,614,698 | 9/1986 | Miyakawa et al. | 430/111 |

FOREIGN PATENT DOCUMENTS 0010375 6/1973 European Pat. Off. .

OTHER PUBLICATIONS

"Xerography and Related Processes" by J. H. Dessauer and H. E. Clark, editors, published by the Focal Press, London and New York, 1965, pp. 393–398.

"Toner Particle-Photoreceptor Adhesion" by N. S. Goel and P. R. Spencer, published in Polymer Science Technology, 1975, 9B, pp. 763–829.

"Forces Involved in Cleaning of an Electrophotographic Layer" by L. Nebenzahl et al, published in Photographic Science and Engineering, vol. 24, No. 6, Nov./Dec. 1980.

*Primary Examiner*—John L. Goodrow

*Attorney, Agent, or Firm*—Richard D. Fuerle

[57] ABSTRACT

An electrostatographic method of forming a latent electrostatic image, developing the latent image with a toner having an average radius ($r_{avg}$) less than 5 μm, 90% of the particles having a radius of 0.8 $r_{avg}$ to 1.2 $r_{avg}$ and 99% of the toner particles having a radius of 0.5 $r_{avg}$ to 2 $r_{avg}$, electrostatically transferring the developed image to a receiver, the surface of whch has an average peak height less than 0.3 $r_{avg}$ and fixing the image on the receiver.

6 Claims, No Drawings

ELECTROSTATOGRAPHIC METHOD OF MAKING IMAGES

BACKGROUND OF THE INVENTION

This invention relates to a method of making electrostatographic images, and more particularly to an electrostatographic method of producing high quality, high resolution images.

In the art of electrostatography, latent electrostatic images are formed on a surface. Thereafter the latent images are rendered visible by contact with an electrostatic developer composition. Generally, two different types of developer compositions have evolved on the commercial scene. These are classified as dry developers and liquid developers. Dry developers include electroscopic marking particles called toner particles which are employed with or without separate particles to form two component developers or single component developers, respectively. Liquid developers employ a carrier liquid together with marking particles.

Each of these development techniques, have found widespread use in the marketplace. Also, each has disadvantages which require different approaches when viewed from a commercially acceptable perspective. Inherently, liquid development systems are capable of higher quality reproduction of the original image because the particle size of the electroscopic marking particles (toner) are much smaller than that employed in dry developers. Liquid developers transfer readily from the dielectric layer or photoreceptor to the receiving sheet because the transfer takes place while the toner particles are still wet with the carrier liquid.

Dry development systems, on the other hand, are limited with respect to the copy quality of the final image on the receiver sheet by the size of the toner particles. U.S. Pat. No. 4,284,701 issued Aug. 18, 1981 speaks of this in these terms, at Col. 1, line 58 et sec. "Copy quality includes such things as image clarity, i.e., clear delineation of lines; uniform darkness of image areas; background quality, i.e., grayness or lack of it in the background areas; and other somewhat intangible features that go toward making a good 'quality' copy."

Various techniques have been suggested to improve the copy quality of the electrostatographic images including that taught and claimed in the above-mentioned patent which accomplishes this to a certain extent by rigidly controlling the size of the toner particles by a classification technique. U.S. Pat. No. 3,969,251 issued July 13, 1976 also employs classified toner particles. European Patent specification No. 0,010,375 utilizes the classified toner particles of previously mentioned U.S. Pat. No. 3,969,251 together with a dual transfer apparatus. The large particles are transferred at a differnt station than that employed for transferring the smaller particles. In these references, as well as in the commercially available electrostatographic copy devices the predominant toner particles have a volume average size of 8 to 12 microns, but generally include particles having much larger and smaller particles.

Thus, in dry development systems, the resolution of the final image is limited by the particle size of the toner employed and the lower limit of particle size is limited by the forces present on the particles which control whether or not a transfer will occur efficiently. The efficiency drops off as the particle size decreases and more toner remains behind on the photoreceptor. Moreover, the residual toner is more difficult to remove.

Both of these effects escalate cleaning problems. The photoreceptor must be clean of toner particles for the start of the next immediate imaging process. Thus, the transferability of the developed toner image is the limiting factor with regard to the quality of the completed image with respect to resolution.

In order to obtain maximum image clarity of transferred images (as quantified by granularity measurement or other parameters which relate to image resolution), it is important to maintain as low a mean particle size for toners as possible. If the transferred toner particles are too large, fine detail in an image cannot be satisfactorily resolved. The granularity of the completed image tends to increase with the toner size. However, it is found that fundamental difficulties arise when trying to transfer toner particles having an average radius less than 5 μm. This difficulty in transferring small particles is referred to in "Xerography And Related Processes" by J. H. Dessauer and H. E. Clark, editors, published by the Focal Press, London and New York 1965 at pages 393 and 394, an article by N. S. Goel and P. R. Spencer entitled "Toner Particle-Photoreceptor Adhesion" published in *Polymer Science Technology*, 1975, 9B, page 821 and also an article entitled "Forces Involved in Cleaning of an Electrophotographic Layer" by L. Nebenzahl et al (IBM) *Photographic Science & Engineering* 24, 293–298 (1980) which refers to IBM toner at 10 μm being held by Van der Waals' forces.

SUMMARY OF THE INVENTION

The present invention provides an electrostatographic method of producing high quality images having low granularity and high resolution by forming a latent electrostatic image on a surface, developing the latent electrostatic image with dry toner particles having an average radius less than 5 microns wherein 90% of the particles have a radius within the range of from about 0.8 $r_{avg}$ to about 1.2 $r_{avg}$ and 99% of the toner particles have a radius within the range of from about 0.5 $r_{avg}$ to about 2 $r_{avg}$, electrostatically transferring the developed image to a receiver, the surface of the receiver having an average peak height ($R_a$) less than 0.3 $r_{avg}$.

DETAILED DESCRIPTION OF THE INVENTION

High quality, high resolution, low granularity images are made by an electrostatographic method wherein a latent electrostatic image on a surface, such as a dielectric surface or a photoreceptor, is developed with toner particles having an average radius less than about 5 microns wherein 90% of the particles have a radius within the range of from about 0.8 $r_{avg}$ to about 1.2 $r_{avg}$ and 99% of the toner particles have a radius within the range of from about 0.5 $r_{avg}$ to about 2 $r_{avg}$, the particles present on the photoreceptor are then electrostatically transferred to a receiver the surface of which has an average peak height ($R_a$) less than about 0.3 $r_{avg}$ and preferably less than 0.2 $r_{avg}$ and subsequently thereto, the image is fixed to the receiver sheet. It is preferred that the $r_{avg}$ of the toner particles is less than about 3.5 μm and most preferably within the range of from about 0.5 to about 3.5 μm.

It can be seen that close tolerances are required not only with regard to the particle size of the toner and the surface roughness of the receiver, as indicated by the average peak height, but also of relationship of the size of the toner particles to the profile characteristics of the receiver surface. By $r_{avg}$ is meant the volume average radius. A suitable device for determining this value is a PA-720 Automatic Particle Size Analyzer made by Pacific Scientific of Montclair, Calif. This device gives the average radius and the particle distribution as required above directly. Other devices such as the Coulter Counter can also be used to determine $r_{avg}$.

Average peak height is an indication of surface roughness, the value of which is the average height of the peaks in micrometers above the mean line between peaks and valleys. A suitable device to measure this value directly is a Surtronic 3 surface roughness instrument supplied by Rank Taylor Hobson, P.O. Box 36, Guthlaxton Street, Leicester LE205P England. This device measures and provides a read-out of $R_a$ directly in $\mu$m. In the process in accordance with this invention, it is preferred that the toner particles be substantially spherical in configuration. However, toners falling within the parameters set forth above regardless of their shape may be employed in the process of this invention.

The toners employed in the present invention can be prepared by any suitable method of preparation known in the art so long as the finished toner material falls within the parameters set forth above. The polymer material from which the toners are prepared may be polymerized in bulk and then ground by suitable techniques known in the art to achieve a particulate material having substantially the size characteristics desired. Subsequently, classification techniques can be used in order to establish clearly that the toner particles employed in the development process satisfy the 90% and 99% limitations set forth.

European patent application No. 0,003,905 filed Feb. 21, 1979 teaches a method suitable for use in preparing toner that may be used in accordance with this invention. This application describes a two step process for diffusing monomers into polymers and thereafter conducting the polymerization. The particles in the resulting latex are substantially spherical in form and generally have a mean particle size of from about 1 to about 4 micrometers. Dyes may be incorporated into the particles by adding dyes simultaneously with the formation of the polymers or subsequently thereto.

Alternatively, a surfactant-free emulsion polymerization process as described in *Research Disclosure,* Item 15963, published July, 1977 may be employed to prepare toner particles useful in this invention. In this procedure, continuous emulsion polymerization takes place in the absence of a surfactant. Three steps are described (1) the simultaneous introduction of monomers, initiator and additional components, (2) maintaining a high-free radical concentration at elevated temperatures, and high initiator concentration in the final step and (3) collecting the steady state product which is formed at the rate at which the reactants are introduced into the system, thereby maintaining constant volume. The resulting particles are thereafter optionally isolated to form the desired toner particles.

Spray drying of a solution of a polymer and a solvent may also be employed in order to form toner particles useful in this invention. Once again, colorants, such as dyes or pigments may be incorporated into the solution prior to spray drying or the particles can be dyed subsequent to their formation by dissolving the dye in a solvent therefor but which does not dissolve the particles, adding the dye solution to an aqueous dispersion of the particles and subsequently separating the particles by any suitable technique. In any of the methods enumerated herein for the formation of toner particles, all of which are known in the prior art, it may be necessary to perform a classification step in order to achieve a toner composition having a particle distribution within the 90% to 99% parameters required by this invention.

The toner resin can be selected from a wide variety of materials, including both natural and synthetic resins and modified natural resins, as disclosed, for example, in the patent to Kasper et al, U.S. Pat. No. 4,076,857 issued Feb. 28, 1978. Especially useful are the crosslinked polymers disclosed in the patent to Jadwin et al, U.S. Pat. No. 3,938,992 issued Feb. 17, 1976 and the patent to Sadamatsu et al, U.S. Pat. No. 3,941,898 issued March 2, 1976. The crosslinked or noncrosslinked copolymers of styrene or lower alkyl styrenes with acrylic monomers such as alkyl acrylates or methacrylates are particularly useful. Also useful are condensation polymers such as polyesters.

The toner can also contain minor components such as charge control agents and antiblocking agents. Especially useful charge control agents are disclosed in U.S. Pat. No. 3,893,935 and British Pat. No. 1,501,065. Quaternary ammonium salt charge agents as disclosed in *Research Disclosure,* No. 21030, Volume 210, October, 1981 (published by Industrial Opportunities Ltd., Homewell, Havant, Hampshire, P09 1EF, United Kingdom), are also useful.

After the desired toners are prepared, they can be incorporated into developers without further addenda. They can be used as such for single component developers. Alternatively, and preferably, the toners are combined with carrier particles to form two component developers. Preferably the carriers are magnetic and can be used with a magnetic brush to form the developed images in accordance with this invention.

As previously noted, the present method entails first the formation of an electrostatic image on a surface such as, an electrically insulating or a photoconductive layer. Such layers are commonly employed as the outermost layers of photoconductor elements or dielectric recording elements. Their purpose is to provide a surface which is capable of being charged and holding the charge until it can be developed into a toner image in accordance with known electrographic developing techniques.

Since the average radius of the toner particles can vary from less than one micrometer to approximately 5 micrometers, some receiving sheets may be suitable for use at the upper limit of the toner particle size but not suitable at the lower limits. It is for this reason that the average peak height of the surface of the receiver sheet is given with respect to the average radius of the toner particles because it is indeed necessary that the particular receiving sheet have a profile relative to the average size of the toner particles. That is, either the receiving sheets employed must be matched to the toner average size and size distribution utilized or the toner average size and size distribution must be matched to the surface profilometry of the receiving sheet.

Any receiver having a surface profile as set forth may be used such as, for example, coated or uncoated polymeric films including polyester films, polyethylene terephthalate films, polystyrene films and the like; coated or uncoated papers specially calendered to achieve high smoothness including commercially available lithographic stock such as, Krome Kote® (manufactured by Champion), Potlatch Vintage Gloss® (manufactured by Potlatch), Consolidated Centura Offset Enamel® (manufactured by Consolidated Papers), Champion Camelot Gloss Coat Offset (manufactured by Champion), Warren Luster Enamel Gloss (manufactured by Warren) and the like. Photograph papers minus the photosensitive emulsions such as Ektaflex supplied by the assignee hereof are useful in the practice of this invention.

The relationship between the toner particle size and the surface profile of the receiver is shown in the following table:

| Particle Size (μm) | $r_{avg}$ of toner (μm) | 90% range (μm) | 99% range (μm) | $R_a$ <0.3 $r_{avg}$ (μm) |
|---|---|---|---|---|
| 0.5 | 0.25 | 0.2–0.3 | 0.1–0.5 | <0.075 |
| 1 | 0.5 | 0.4–0.6 | 0.25–1 | <0.15 |
| 1.5 | 0.75 | 0.6–0.9 | 0.375–1.5 | <0.225 |
| 2 | 1 | 0.8–1.2 | 0.5–2 | <0.3 |
| 2.5 | 1.25 | 1–1.5 | 0.625–2.5 | <0.375 |
| 3 | 1.5 | 1.2–1.8 | 0.75–3 | <0.45 |
| 3.5 | 1.75 | 1.4–2.1 | 0.875–3.5 | <0.525 |
| 4 | 2 | 1.6–2.4 | 1.0–4 | <0.6 |
| 4.5 | 2.25 | 1.8–2.7 | 1.125–4.5 | <0.675 |
| 5 | 2.5 | 2–3 | 1.25–5 | <0.75 |
| 6 | 3 | 2.4–3.6 | 1.5–6 | <0.9 |
| 7 | 3.5 | 2.8–4.2 | 1.75–7 | <1.05 |
| 8 | 4 | 3.2–4.8 | 2–8 | <1.2 |

While it is not intended to be bound by any theory by which the present invention operates, it is believed that small particles such as employed in the practice of this invention are tightly bound to the photoreceptor surface because the surface forces (e.g. Van der Waals forces) exceed the forces exerted on the charged toner due to the applied electrostatic field. When this occurs, the small particles cannot be transferred from the photoreceptor surface to the receiving surface by merely increasing the electric field strength because the dielectric breakdown of air (Paschen Breakdown) occurs prior to the time that sufficient force can be applied to the particles to overcome the surface forces and move the toner particles from the surface of the photoreceptor to the surface of the receiving sheet. For these reasons methods of transferring larger particles (say, over 12 μm volume average diameter) fail to transfer smaller particles. Moreover, improvements in image quality found by merely narrowing the size distribution of the larger toners without concern for the shape of the toner or smoothness of the receiver cannot be extrapolated to the smaller particles. It is believed that in the practice of this invention the surface forces in the direction of the receiving sheet and in the direction of the photoreceptor are balanced and therefore the applied electrostatic force brings about the transfer of the toner to the receiving sheet. These surface forces are balanced because the toner particles are in contact with the receiving sheet or other particles on a particle by particle basis, and no particles is forced to jump across an air gap. Where the surface of the receiving sheet is not within the parameters set forth above, the toner particles are only capable of engaging the surface of the receiver at the peaks of the profile of the paper and therefore transfer occurs only at these points. Where the toner particles are larger in size, the surface forces are small when compared with the electrostatic forces and therefore play no appreciable part in determining whether or not transfer will occur. In such cases the toner has no problem in traversing the air gap between its position on the photoreceptor and the receiving surface.

The invention will be further illustrated by the following examples:

EXAMPLE 1

A 5 liter round bottom 3-necked flask is equipped with a stirrer, baffle with nitrogen inlet, a 3 hole stopper for the addition of three streams of reactants and a side-arm outlet filled with distilled water and sparged with nitrogen for 20 minutes. Three reactor mixes are formulated in accordance with the following recipes:

| | |
|---|---|
| Reactor Stream 1 | |
| styrene | 7.5 kilograms (Kg) |
| butylacrylate | 2.5 Kg |
| divinylbenzene | 0.135 Kg |
| Reactor Stream 2 | |
| water | 10 Kg |
| potassium persulfate ($K_2S_2O_8$) | 0.1 Kg |
| hydrogen peroxide (30% solution) | 0.4 Kg |
| Reactor Stream 3 | |
| water | 10 Kg |
| sodium meta-bisulfite ($Na_2S_2O_5$) | 0.07 Kg |

All solutions are sparged with nitrogen gas to remove oxygen and then stored in containers in a nitrogen atmosphere. The flask and its contents are immersed in a bath of boiling water. The contents of the flask are allowed to come to an equilibrium temperature and the reagents are then added at the rate of 4 ml per minute each. After 5 residence times material is collected and characterized. The geometric mean size of the particles as measured by disk centrifuge is 2.2 μm and the geometric standard deviation is 1.6.

600 g of a 12.36% aqueous latex solution of the particles as prepared as immediately set forth above are added to 5.4 Kg of methanol containing 14.8 gms. of Sudan Black, previously heated to 40° C. and filtered to remove undissolved dye. This latex is diluted to 1% solids and spray dried under the following conditions in a Niro spray dryer and collected in a Tan Jet Cyclone:

| | |
|---|---|
| Drying Gas | Nitrogen |
| Inlet Air Temperature | 146° C. |
| Outlet Air Temperature | 45 to 57° C. |
| Gas Flow Rate | 2407 liters/min |
| Solution Flow Rate (ml per minute) | 30 |
| Percent Solids | 1 |
| Atomizer Sonic System Nozzle plus Ionizer | 2050-100 |
| Atomizer Operating Condition (PSI) | 620.5 kPa |
| Amount Sprayed (grams) | 74 |
| Amount Collected in Tan Jet | 32.6 g |

This material is classified by repeated screening to produce a toner having an $r_{avg}$ of 1.3 μm, 90% of the particles having a radius within the range of 1.1 μm to 1.5 μm and 99% of the particles being within the range of 0.7 μm to 2.5 μm. These measurements are made on a PA-720 Automatic Particle Size Analyzer made by Pacific Scientific Company.

EXAMPLE 2

An electrographic dry developer is prepared by mixing 8 g of the black toner as prepared in Example 1 with 72 g of uncoated gamma ferric oxide carrier particles, as disclosed in U.S. Pat. No. 4,546,060 issued Oct. 8, 1985. This developer is utilized in an electrographic apparatus as described in U.S. Pat. No. 4,473,029 issued Sept. 25, 1984. The photoconductive element of that device is charged initially at −500 volts and exposed with white light through a 0.3 neutral density step tablet. The magnetic brush is biased at −50 volts. The developed image is electrostatically transferred to a Krome Kote TM paper receiver. This paper receiver has a $R_a$ of 0.33 as measured on a Surtronic 3. The transfer station includes a roller transfer device including a high resistance roller biased to approximately −4000 volts which is applied to the backside of the Krome Kote TM paper receiver. A visual inspection of the photoconductive element prior to cleaning reveals that substantially all of the toner particles are transferred to the Krome Kote TM receiver and that the image produced is of high resolution. Some mottle corresponding to the paper surface is observed.

EXAMPLE 3

About 2600 ml of dionized water containing 0.0625 g of sodium chloride (NaCl) dissolved therein are introduced into a 3 liter, 3 three neck flask containing a stirrer, condenser and $N_2$ inlet. This solution is evacuated four times to a boil and vented with nitrogen each time. About 40 g of distilled styrene (having the initiator removed) and about 0.08 g of $K_2S_2O_8$ and 12.5 ml of deionized water are added and the mixture stirred for 16 hours at 70° C. under a nitrogen bleed. A 1.5 weight percent solid dispersed latex results the particles thereof having a diameter of about 0.4 μm.

About 2122 g of the dispersion as prepared above are introduced into a 5 liter 3-neck flask containing a stirrer, condenser and nitrogen inlet. In a separate container, a mixture of 800 ml of deionized water, 6.4 g of $K_2S_2O_8$ and about 4.96 g of sodium lauryl sulfate is prepared. About 208 g of styrene are next added to the 5 liter flask and then about 600 ml of the deionized water $K_2S_2O_8$ and sodium lauryl sulfate mixture are added to the flask over a period of 8 hours at temperature 70° C. under a nitrogen bleed. The stirring is continued for 16 hours under these conditions. A very uniform dispersion of polystyrene spheres results having an average radius of 0.5 μm. The solids content of the dispersion is about 8.4 percent by weight.

The following ingredients are charged into a 1 liter flask containing a stirrer, condenser and nitrogen inlet: 100 g of the aqueous dispersion prepared immediately above containing 5 g of polystyrene spheres, 84 g of styrene monomer, 36 g of vinylbenzene chloride, 1.61 g of divinylbenzene (55%) 6 g of benzoyl peroxide, 144 ml of dionized water, 96 g of polyvinylalcohol (12% acetate), 19.2 ml of a 2.5% aqueous solution of $K_2C_r2O_7$ and about 0.72 g of sodium lauryl sulfate. This mixture is stirred for 4 hours at 30° C. The bath temperature is then raised to 60° C. and the system evacuated four times to a boil, venting each time with nitrogen to remove oxygen. The mixture is stirred 20 hours under a nitrogen bleed. The product is of a dispersion of spherical particles having an $r_{avg}$ of 1.2 μm, 90% of the particles have a radius within the range of 1 μm to 1.4 μm and 99% of the particles have a radius within the range of 0.7 μm to 2 μm, which are then washed twice by centrifugation with water.

The procedure in accordance with Example 1 for dyeing the particles black is repeated substituting the immediately preceding aqueous dispersion for that in Example 1.

EXAMPLE 4

The procedure outlined in Example 2 is repeated substituting the toner particles of Example 3 for that used in Example 2 and Ektaflex paper supplied by the assignee hereof for Krome Kote paper. The Ektaflex paper has an $R_a$ of 0.22. The images formed show very high resolution. The mottle described in Example 2 is mitigated.

EXAMPLE 5

The procedure of Examples 2 and 4 are repeated using as the receiver in the transfer step a film of nickelized polyethylene terephthalate coated with a 30 μm thickness of titanium dioxide in a polyurethane binder sold under the trademark Estane by B. F. Goodrich which is overcoated with a 2 μm thickness of cellulose acetate polymer. This receiver exhibits an $R_a$ of 0.18 μm.

The image quality and resolution of both are excellent and no visual evidence of toner particles remains on the photoreceptor surface.

It is to be understood that other toner materials and receiving sheets can be used throughout these examples in place of those particularly used, provided that the size parameters of the toner particles and the average peak height of the receiver have the relationship set forth above.

What is claimed is:

1. An electrostatographic method of producing an image which comprises forming a latent electrostatic image on a surface, developing said latent electrostatic image with dry toner particles having an average radius ($r_{avg}$) of less than about 5 μm, wherein 90% of the particles have a radius within the range of from about 0.8 $r_{avg}$ to about 1.2 $r_{avg}$ and 99% of the toner particles have a radius within the range of from about 0.5 $r_{avg}$ to about 2 $r_{avg}$, electrostatically transferring the developed image to a receiver, the surface of the receiver having an average peak height less than about 0.3 $r_{avg}$ of the toner particles and fixing said transferred toner image on said receiver.

2. The method of claim 1 wherein $r_{avg}$ is less than about 3.5 μm.

3. The method of claim 1 wherein $r_{avg}$ is from about 0.5 μm to about 3.5 μm.

4. The method of claim 1 wherein the toner particles are substantially spherical.

5. The method of claim 1 wherein the average peak height of the receiver is less than about 0.2 $r_{avg}$ of the toner particles.

6. The method of claim 3 wherein the average peak height of the receiver is less than about 0.2 $r_{avg}$ of the toner particles.

* * * * *